US009119521B2

(12) United States Patent
Delgado et al.

(10) Patent No.: US 9,119,521 B2
(45) Date of Patent: Sep. 1, 2015

(54) SPRAY ASSEMBLY FOR A DISHWASHER

(75) Inventors: Kristopher L. Delgado, Stevensville, MI (US); Sathish A. Sundaram, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 1428 days.

(21) Appl. No.: 12/796,762

(22) Filed: Jun. 9, 2010

(65) Prior Publication Data

US 2011/0303250 A1 Dec. 15, 2011

(51) Int. Cl.
*A47L 15/42* (2006.01)
*A47L 15/22* (2006.01)

(52) U.S. Cl.
CPC ..... *A47L 15/4282* (2013.01); *A47L 15/22* (2013.01); *A47L 15/4221* (2013.01)

(58) Field of Classification Search
CPC .. A47L 15/22; A47L 15/4221; A47L 15/4282
USPC ..... 68/57 D, 56 D, 58 D, 198–199, 23.6; 134/57 D, 56 D, 58 D, 198–199
See application file for complete search history.

(56) References Cited

U.S. PATENT DOCUMENTS

| | | | | |
|---|---|---|---|---|
| 3,160,164 | A * | 12/1964 | Constance et al. | 134/176 |
| 3,261,554 | A * | 7/1966 | Perl | 239/252 |
| 4,989,786 | A | 2/1991 | Kranzle et al. | |
| 5,577,665 | A * | 11/1996 | Chang | 239/256 |
| 5,752,533 | A | 5/1998 | Edwards | |
| 5,755,244 | A | 5/1998 | Sargeant et al. | |
| 5,842,492 | A | 12/1998 | Lee | |
| 5,924,432 | A | 7/1999 | Thies et al. | |
| 6,092,540 | A | 7/2000 | Chiao | |
| 7,270,132 | B2 * | 9/2007 | Inui et al. | 134/56 D |
| 7,614,408 | B2 * | 11/2009 | Park et al. | 134/56 D |
| 7,914,625 | B2 * | 3/2011 | Bertsch et al. | 134/25.2 |
| 2005/0230502 | A1 | 10/2005 | Bragg et al. | |
| 2006/0108454 | A1 | 5/2006 | Eichholz | |
| 2006/0278258 | A1 | 12/2006 | Kara et al. | |
| 2007/0295361 | A1 | 12/2007 | Thiyagarajan et al. | |

FOREIGN PATENT DOCUMENTS

| | | |
|---|---|---|
| DE | 7122831 | 6/1971 |

* cited by examiner

*Primary Examiner* — Michael Barr
*Assistant Examiner* — Kevin G Lee

(57) ABSTRACT

A dishwasher includes a spray assembly positioned in the wash chamber of the dishwasher's tub. The spray assembly includes a spray arm that is driven by an input shaft. The input shaft is operable to both drive the spray arm and selectively divert wash fluid to the fluid nozzles associated with the wings of the spray arm.

26 Claims, 4 Drawing Sheets

SPRAY ASSEMBLY FOR A DISHWASHER

TECHNICAL FIELD

The present disclosure relates generally to a dishwasher and more particularly to a spray assembly for a dishwasher.

BACKGROUND

A dishwasher is a domestic appliance into which dishes and other cooking and eating wares (e.g., plates, bowls, glasses, flatware, pots, pans, bowls, etcetera) are placed to be washed. A dishwasher includes a number of dish racks which support such wares. During a cleaning cycle, the dishwasher sprays wash fluid (i.e., water and/or a wash chemistry) on the wares in the dish racks.

SUMMARY

According to one aspect, a dishwasher includes a tub defining a washing chamber and one or more dish racks positioned in the washing chamber. A rotating spray arm is positioned in the washing chamber to spray wash fluid on the one or more dish racks. The rotating spray arm includes a hub defining a central fluid chamber having a first outlet and a second outlet. A first wing extends outwardly from the hub. The first wing has a fluid chamber that is fluidly coupled to the central fluid chamber via the first outlet. A second wing extends outwardly from the hub. The second wing has a fluid chamber that is fluidly coupled to the central fluid chamber via the second outlet. An input shaft has a first end positioned in the hub of the spray arm and a second end extending outwardly from the hub of the spray arm. The input shaft is rotatable relative to the spray arm. The first end of the input shaft includes a flange. Rotation of the input shaft in a clockwise direction causes the flange to drive the spray arm in the clockwise direction, and prevent wash fluid from advancing through the second outlet of the central fluid chamber of the spray arm. Rotation of the input shaft in a counterclockwise direction causes the flange to drive the spray arm in the counterclockwise direction, and prevent wash fluid from advancing through the first outlet of the central fluid chamber of the spray arm.

The input shaft may include a cannulated stem having a disk secured thereto. The disk may be positioned in the hub of the spray arm. The flange may include an annular-shaped flange secured to a portion of the outer periphery of the disk.

The hub of the spray arm may include a sidewall having a first shoulder and a second shoulder extending inwardly from the sidewall into the central fluid chamber. Rotation of the input shaft in a clockwise direction causes the flange to contact the second shoulder so as to drive the spray arm in the clockwise direction. Rotation of the input shaft in a counterclockwise direction causes the flange to contact the first shoulder so as to drive the spray arm in the counterclockwise direction.

The flange fluidly isolates the fluid chamber of the first wing from the central fluid chamber when the flange is positioned in contact with the first flange. Moreover, the flange fluidly isolates the fluid chamber of the second wing from the central fluid chamber when the flange is positioned in contact with the second flange.

The disk is secured to a first end of the cannulated stem such that a bore extending through the stem opens into the central fluid chamber of the spray arm. A second end of the cannulated stem is fluidly coupled to a fluid pump such that fluid pumped by the fluid pump is advanced through the stem and into the central fluid chamber.

The first wing may include a rib that divides the fluid chamber of the first wing into a pair of separate fluid chambers. Rotation of the input shaft in a clockwise direction causes the flange to contact the first rib so as to drive the spray arm in the clockwise direction.

In an embodiment, the flange fluidly isolates one of the pair of separate fluid chambers of the first wing from the central fluid chamber when the flange is positioned in contact with the first rib. The other of the pair of separate fluid chambers of the first wing being is fluidly coupled to the central fluid chamber when the flange is positioned in contact with the first rib.

The second wing may include a rib that divides the fluid chamber of the second wing into a pair of separate fluid chambers. Rotation of the input shaft in a counterclockwise direction causes the flange to contact the second rib so as to drive the spray arm in the counterclockwise direction.

In an embodiment, the flange fluidly isolates one of the pair of separate fluid chambers of the second wing from the central fluid chamber when the flange is positioned in contact with the second rib. The other of the pair of separate fluid chambers of the second wing being is fluidly coupled to the central fluid chamber when the flange is positioned in contact with the second rib.

The second wing may extend outwardly from the hub in a direction opposite the first wing.

The input shaft may be coupled to an output of a drive motor.

According to another aspect, a dishwasher includes a tub defining a washing chamber and one or more dish racks positioned in the washing chamber. A rotating spray arm is positioned in the washing chamber to spray wash fluid on the one or more dish racks. The rotating spray arm includes a hub defining a central fluid chamber. A first wing extends outwardly from the hub. The first wing has a fluid chamber. A second wing extends outwardly from the hub. The second wing has a fluid chamber. An input shaft is rotatable relative to the spray arm. The input shaft includes a flange positioned in the central fluid chamber of the spray arm. Rotation of the input shaft in a clockwise direction causes the flange to drive the spray arm in the clockwise direction, and fluidly isolate the fluid chamber of the second wing from the central fluid chamber of the spray arm. Rotation of the input shaft in a counterclockwise direction causes the flange to drive the spray arm in the counterclockwise direction, and fluidly isolate the fluid chamber of the first wing from the central fluid chamber of the spray arm.

The input shaft may include a cannulated stem having a disk secured thereto. The disk may be positioned in the hub of the spray arm. The flange may include an annular-shaped flange secured to a portion of the outer periphery of the disk.

The hub of the spray arm may include a sidewall having a first shoulder and a second shoulder extending inwardly from the sidewall into the central fluid chamber. Rotation of the input shaft in a clockwise direction causes the flange to contact the second shoulder so as to drive the spray arm in the clockwise direction. Rotation of the input shaft in a counterclockwise direction causes the flange to contact the first shoulder so as to drive the spray arm in the counterclockwise direction.

The flange fluidly isolates the fluid chamber of the first wing from the central fluid chamber when the flange is positioned in contact with the first flange. Moreover, the flange fluidly isolates the fluid chamber of the second wing from the central fluid chamber when the flange is positioned in contact with the second flange.

The disk is secured to a first end of the cannulated stem such that a bore extending through the stem opens into the central fluid chamber of the spray arm. A second end of the cannulated stem is fluidly coupled to a fluid pump such that fluid pumped by the fluid pump is advanced through the stem and into the central fluid chamber.

The first wing may include a rib that divides the fluid chamber of the first wing into a pair of separate fluid chambers. Rotation of the input shaft in a clockwise direction causes the flange to contact the first rib so as to drive the spray arm in the clockwise direction.

In an embodiment, the flange fluidly isolates one of the pair of separate fluid chambers of the first wing from the central fluid chamber when the flange is positioned in contact with the first rib. The other of the pair of separate fluid chambers of the first wing being is fluidly coupled to the central fluid chamber when the flange is positioned in contact with the first rib.

The second wing may include a rib that divides the fluid chamber of the second wing into a pair of separate fluid chambers. Rotation of the input shaft in a counterclockwise direction causes the flange to contact the second rib so as to drive the spray arm in the counterclockwise direction.

In an embodiment, the flange fluidly isolates one of the pair of separate fluid chambers of the second wing from the central fluid chamber when the flange is positioned in contact with the second rib. The other of the pair of separate fluid chambers of the second wing being is fluidly coupled to the central fluid chamber when the flange is positioned in contact with the second rib.

The second wing may extend outwardly from the hub in a direction opposite the first wing.

The input shaft may be coupled to an output of a drive motor.

According to yet another aspect, a dishwasher includes a tub defining a washing chamber and one or more dish racks positioned in the washing chamber. A rotating spray arm is positioned in the washing chamber to spray wash fluid on the one or more dish racks. The rotating spray arm includes a hub with a pair of wings extending outwardly therefrom. An input shaft is rotatable relative to the spray arm. The input shaft includes a first end positioned in the hub of the spray arm and a second end extending outwardly from the hub of the spray arm. A fluid pump is fluidly coupled to the second end of the input shaft. Rotation of the input shaft in a clockwise direction causes the input shaft to drive the spray arm in the clockwise direction and isolate the fluid pump from a number of spray nozzles of the second wing of the spray arm. Rotation of the input shaft in a counterclockwise direction causes the input shaft to drive the spray arm in the counterclockwise direction, and isolate the fluid pump from a number of spray nozzles of the first wing of the spray arm.

The input shaft includes a cannulated stem having a disk secured thereto. The disk is positioned in the hub of the spray arm. The disk has an annular-shaped flange secured to a portion of the outer periphery thereof.

The hub of the spray arm may include a sidewall having a first shoulder and a second shoulder extending inwardly from the sidewall into the central fluid chamber. Rotation of the input shaft in a clockwise direction causes the flange to contact the second shoulder so as to drive the spray arm in the clockwise direction. Rotation of the input shaft in a counterclockwise direction causes the flange to contact the first shoulder so as to drive the spray arm in the counterclockwise direction.

The flange fluidly isolates the fluid pump from the number of spray nozzles of the second wing of the spray arm. The flange fluidly isolates the fluid pump from the number of spray nozzles of the first wing of the spray arm.

The disk is secured to a first end of the cannulated stem such that a bore extending through the stem opens into the hub of the spray arm. A second end of the cannulated stem is fluidly coupled to the fluid pump such that fluid pumped by the fluid pump is advanced through the stem and into the hub of the spray arm.

The number of spray nozzles of the first wing may include a first plurality of spray nozzles and a second plurality of spray nozzles. Moreover, the first wing of the spray arm may include a first rib that fluidly isolates the first plurality of spray nozzles of the first wing from the second plurality of spray nozzles of the first wing.

The number of spray nozzles of the second wing may include a first plurality of spray nozzles and a second plurality of spray nozzles. In an embodiment, the second wing of the spray arm includes a second rib that fluidly isolates the first plurality of spray nozzles of the second wing from the second plurality of spray nozzles of the second wing.

Rotation of the input shaft in a clockwise direction may cause the flange to contact the first rib so as to drive the spray arm in the clockwise direction, whereas rotation of the input shaft in a counterclockwise direction may cause the flange to contact the second rib so as to drive the spray arm in the counterclockwise direction.

The flange may fluidly isolate the first plurality of spray nozzles of the first wing from the fluid pump when the flange is positioned in contact with the first rib, whereas the second plurality of spray nozzles of the first wing may be fluidly coupled to the fluid pump when the flange is positioned in contact with the first rib.

The flange may fluidly isolate the first plurality of spray nozzles of the second wing from the fluid pump when the flange is positioned in contact with the second rib, whereas the second plurality of spray nozzles of the second wing may be fluidly coupled to the fluid pump when the flange is positioned in contact with the second rib.

The second wing may extend outwardly from the hub in a direction opposite the first wing.

The input shaft may be coupled to an output of a drive motor.

BRIEF DESCRIPTION OF THE DRAWINGS

The detailed description particularly refers to the following figures, in which.

DETAILED DESCRIPTION OF THE DRAWINGS

Figure 1:
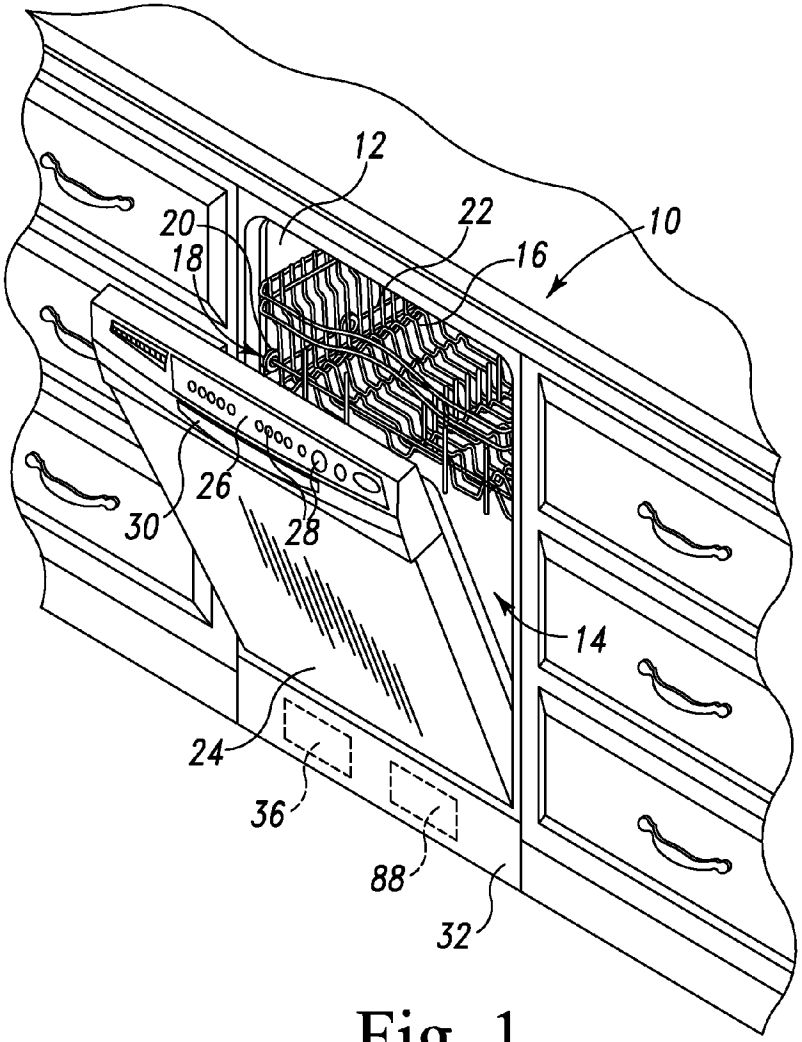
FIG. 1 is fragmentary perspective view of a dishwasher installed in a kitchen cabinet.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the invention as defined by the appended claims.

Referring now to FIG. 1, there is shown a dishwasher 10 having a tub 12 which defines a washing chamber 14 into which dishes and other cooking and eating wares (e.g., plates, bowls, glasses, flatware, pots, pans, bowls, etcetera) are placed to be washed. The dishwasher 10 includes a number of racks 16 located in the tub 12. An upper dish rack 16 is shown in FIG. 1, although a lower dish rack is also included in the dishwasher 10. A number of roller assemblies 18 are positioned between the dish rack 16 and the tub 12. The roller assemblies 18 allow the dish racks 16 to extend from, and retract back into, the tub 12. Such movement facilitates the loading and unloading of the dish racks 16. The roller assemblies 18 include a number of rollers 20 which roll along the top of, and in some cases the top and bottom of, a corresponding support rail 22.

A door 24 is hinged to the lower front edge of the tub 12. The door 24 permits access to the tub 12 to load and unload the dishwasher 10. The door 24 also seals the front of the dishwasher 10 during a wash cycle. A control panel 26 is located at the top of the door 24. The control panel 26 includes a number of controls 28, such as buttons and knobs, that are used to control operation of the dishwasher 10. A handle 30 is also included in the control panel 26. The handle 30 is operable by a user to unlatch the door 24 so that it may be opened by a user.

A machine compartment 32 is located below the tub 12. The machine compartment 32 is sealed from the tub 12. In other words, unlike the tub 12 which fills with water and is exposed to water spray, the machine compartment 32 does not fill with water and is not exposed to water spray during operation of the dishwasher 12. The machine compartment 32 houses components such as the dishwasher's water pump(s) and valve(s), along with the associated wiring and plumbing.

Figure 2:
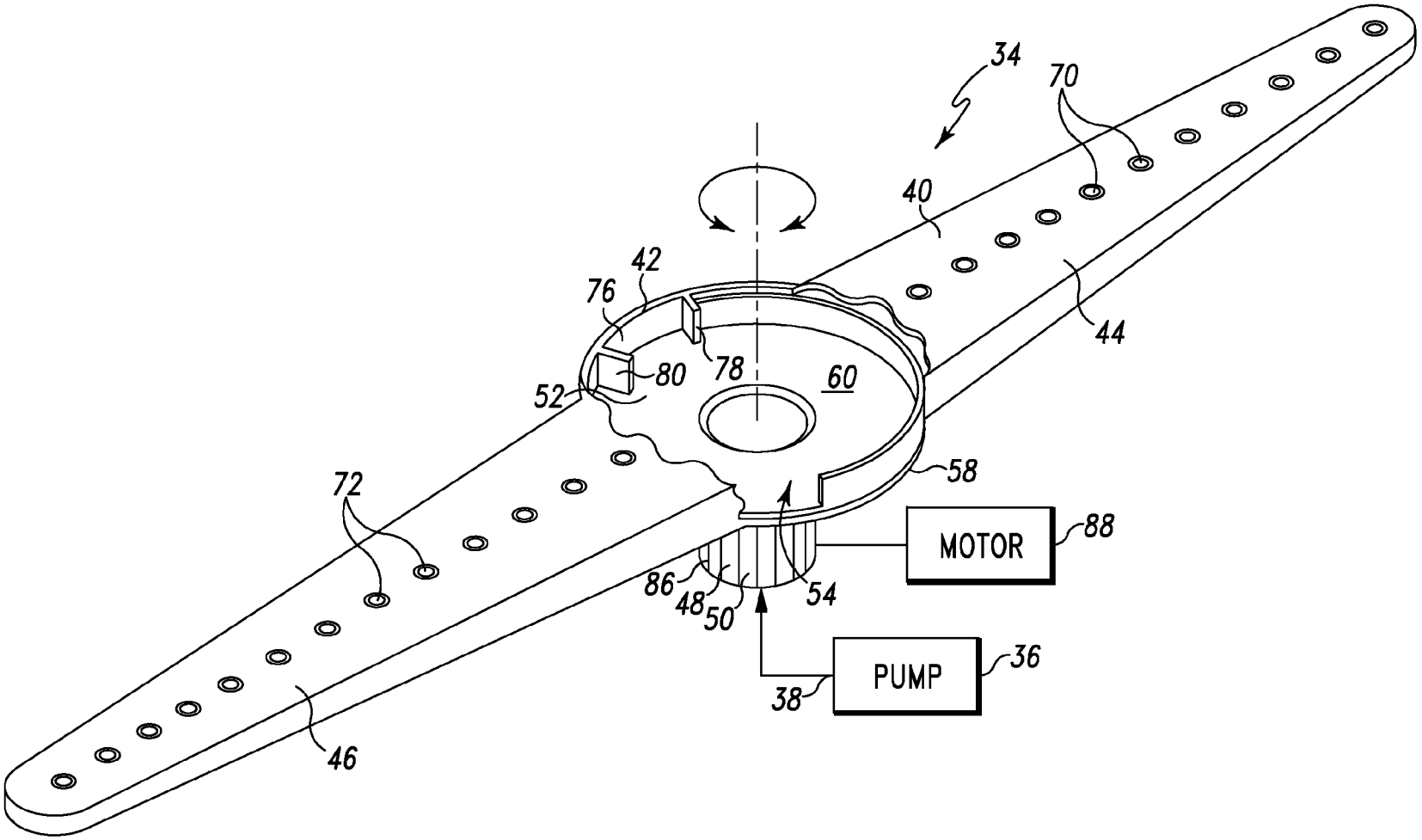
FIG. 2 is a fragmentary perspective view of the spray assembly of the dishwasher of FIG. 1.

Referring now to FIG. 2, there is shown a spray assembly 34. The spray assembly 34 is located in the tub and is operable to spray wash fluid (i.e., water and/or wash chemistry) on the dish racks 16 and hence the eating wares positioned therein. The spray assembly 34 extends out of a bottom wall of the tub 12 and rotates relative thereto. In particular, the bottom wall of the tub 12 has a recirculation sump (not shown) formed therein. The sloped configuration of the tub's bottom wall directs water and/or wash chemistry (i.e., water and/or detergents, enzymes, surfactants, and other cleaning or conditioning chemistry) into the recirculation sump during a wash cycle. Such water and/or wash chemistry is drained from the recirculation sump and re-circulated onto the dish racks 16 by a pump 36 located in the mechanical compartment 32. As will be described in more detail below, the outlet 38 of the pump 36 is coupled to the spray assembly 34 such that wash fluid (i.e., water and/or wash chemistry) pumped by the pump 36 is sprayed onto the dish racks 16 by the spray assembly 34.

The spray assembly 34 includes a spray arm 40 having a central hub 42 with a pair of wings 44, 46 extending in opposite directions outwardly from the central hub 42. The spray assembly 34 also includes an input shaft 48 that drives the spray arm 40. The spray arm 40 and the input shaft 48 are rotatable relative to one another. In particular, the input shaft 48 includes a cannulated stem 50 having a disk 52 secured to its upper end 54. The disk 52 is positioned in the central hub 42 of the spray arm 40. The cannulated stem 50 extends out of a hole 56 (see FIGS. 4 and 5) in the bottom wall 58 of the central hub 42 of the spray arm 40. A sealed bearing (not shown) is positioned in the hole 56 so as to allow the central hub 42 (and hence the spray arm 40) to rotate freely of the cannulated stem 50 of the input shaft 48.

Figure 4:
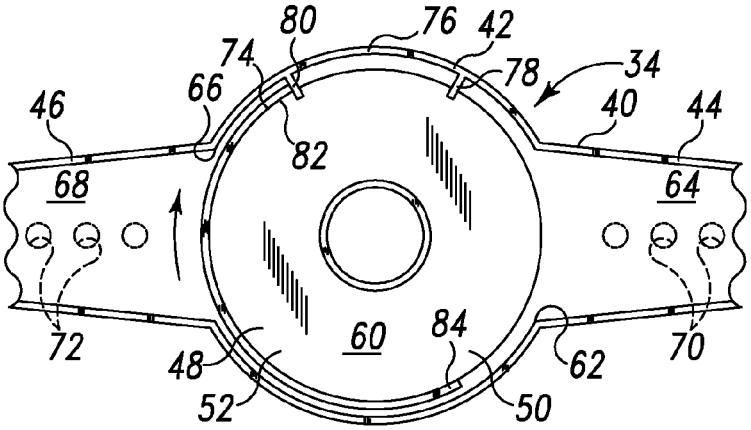
FIG. 4 is a diagrammatic view of the spray assembly of FIG. 2 showing the spray assembly being driven in the clockwise direction.
Figure 5:
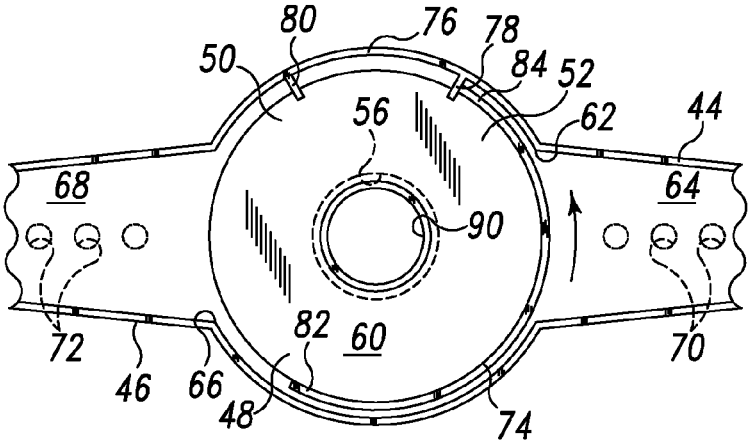
FIG. 5 is a view similar to FIG. 4, but showing the spray assembly being driven in the counterclockwise direction.

The central hub 42 of the spray arm 40 defines a central fluid chamber 60 having an outlet 62 coupled to the fluid chamber 64 of the wing 44 (see FIGS. 4 and 5). The opposite side of the central fluid chamber 60 includes an outlet 66 coupled the fluid chamber 68 of the other wing 46. Wash fluid (i.e., water and/or wash chemistry) pumped by the pump 36 enters the central fluid chamber 60 and is directed through either the outlet 62 into the fluid chamber 64 of the wing 44 where it is sprayed out a plurality of nozzles 70, or, alternatively, the wash fluid is directed through the outlet 66 into the fluid chamber 68 where it is sprayed out a plurality of nozzles 72. Each of the nozzles 70, 72 is embodied as a cannulated tip or other similar structure that is inserted into the holes formed in the wings 44, 46 of the spray arm 40. Such inserts may be configured to create a specific spray direction or spray pattern of the spray arm 40. For example, the nozzles 70 on the wing 44 may be configured to generate a desired spray pattern for use during rotation of the spray arm 40 in the clockwise direction, whereas the nozzles 72 on the wing 46 may be configured to generate a desired spray pattern for use during rotation of the spray arm 40 in the counterclockwise direction. It should be appreciated that in some embodiments, the nozzles may be embodied simply as holes formed in the spray arm 40.

Wash fluid is supplied to the central fluid chamber 60 via the cannulated stem 50 of the input shaft 48. In particular, the cannulated stem 50 of the input shaft 48 has an elongated bore 90 extending through it, the upper end of which opens into the central fluid chamber 60. As shown schematically in FIG. 2, the lower end of the cannulated stem 50 is fluidly coupled to the outlet 38 of the pump 36. As such, wash fluid from the pump 36 is advanced through the bore 90 of the cannulated stem 50 and into the central fluid chamber 60.

Figure 3:
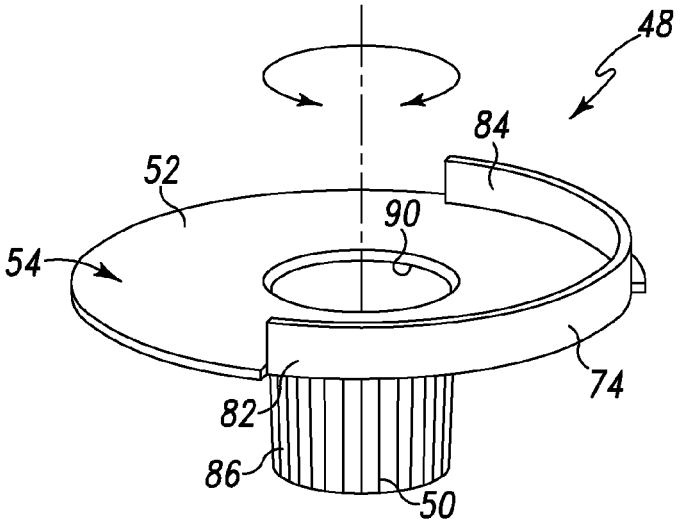
FIG. 3 is a perspective view of the input shaft of the spray assembly of FIG. 2.

The input shaft 48 drives the spray arm 40 and functions as a valve to selectively divert wash fluid between the spray arm's wings 44, 46. As shown in FIG. 3, the disk 52 of the upper end 54 of the input shaft 48 has an annular-shaped flange 74 extending upwardly along a portion of the periphery of the disk 52. The flange 74 engages the spray arm 40 to drive the spray arm 40 in either a clockwise or counterclockwise direction. Specifically, an upwardly extending sidewall 76 of the spray arm 40 has a pair of shoulders 78, 80 that extend inwardly into the central fluid chamber 60 (see FIGS. 4 and 5). As can be seen best in FIG. 4, when the input shaft 48 is rotated in the clockwise direction, an end 82 of the flange 74 is rotated into contact with the shoulder 80 thereby urging the shoulder 80 and hence the spray arm 40 in the clockwise direction. Continued rotation of the input shaft 48 in the clockwise direction drives the spray arm 40 in the same direction. Conversely, as can be seen best in FIG. 5, when the input shaft 48 is rotated in the counterclockwise direction, an end 84 of the flange 74 is rotated into contact with the shoulder 78 thereby urging the shoulder 78 and hence the spray arm 40 in the counterclockwise direction. Continued rotation of the input shaft 48 in the counterclockwise direction drives the spray arm 40 in the same direction.

As shown schematically in FIG. 2, the lower end 86 of the cannulated stem 50 of the input shaft 48 is coupled to a drive motor 88 located in the mechanical compartment 32 of the dishwasher 12. The output of the drive motor 88 may be coupled to the lower end 86 of the cannulated stem 50 in a number of different manners. For example, the input shaft 48 may be belt-driven in which case a drive belt (not shown) couples the cannulated stem 50 to the output of the drive motor 88. The input shaft 48 may also be gear-driven in which case one or more drive gears (not shown) couple the cannulated stem 50 the output shaft of the drive motor 88. It should be appreciated that the drive motor 88 (and/or the drive mechanism coupling the motor to the input shaft) is bi-directional. That is, the input shaft 48 may be selectively driven in either the clockwise or counterclockwise direction.

As noted above, the input shaft 48 also functions as a valve to selectively divert wash fluid between the wings 44, 46 of the spray arm 40. In particular, as shown in FIG. 4, when the input shaft 48 is driving the spray arm 40 in the clockwise direction, the annular flange 74 blocks or otherwise occludes the outlet 66 thereby isolating the fluid chamber 68 of the wing 46 from the central fluid chamber 60 and hence the fluid pump 36. However, the flange 74 does not block the outlet 62 while the input shaft 48 is driving the spray arm 40 in the clockwise direction thereby directing wash fluid pumped from the pump 36 out of the central fluid chamber 60 through the outlet 62 and into the fluid chamber 64 of the wing 44 where it is sprayed out of the nozzles 70. Conversely, as shown in FIG. 5, when the input shaft 48 is driving the spray arm 40 in the counterclockwise direction, the annular flange 74 blocks or otherwise occludes the outlet 62 thereby isolating the fluid chamber 64 of the wing 44 from the central fluid chamber 60 and hence the fluid pump 36. However, the flange 74 does not block the outlet 66 while the input shaft 48 is driving the spray arm 40 in the counterclockwise direction thereby directing wash fluid pumped from the pump 36 out of the central fluid chamber 60 through the outlet 66 and into the fluid chamber 68 of the wing 46 where it is sprayed out of the nozzles 72.

In operation, to drive the spray arm 40 in the clockwise direction, the drive motor 88 is operated to drive the input shaft 48 in the clockwise direction. By doing so, as shown in FIG. 4, the end 82 of the input shaft's flange 74 is rotated into contact with the shoulder 80 of the spray arm 40 thereby urging the shoulder 80 and hence the spray arm 40 in the clockwise direction. Continued rotation of the input shaft 48 in the clockwise direction drives the spray arm 40 in the same direction. During such clockwise rotation of the input shaft 48, the annular flange 74 blocks the outlet 66 thereby fluidly isolating the fluid chamber 68 of the wing 46 (and hence the nozzles 72) from the central fluid chamber 60 and hence the fluid pump 36. Since the flange 74 does not block the outlet 62 while the input shaft 48 is driving the spray arm 40 in the clockwise direction, wash fluid from the fluid pump 36 is directed out of the central fluid chamber 60 through the outlet 62 and into the fluid chamber 64 of the wing 44 where it is sprayed out of the nozzles 70 and onto the dish racks 16.

Conversely, to drive the spray arm 40 in the counterclockwise direction, the drive motor 88 is operated to drive the input shaft 48 in the counterclockwise direction. By doing so, as shown in FIG. 5, the end 84 of the input shaft's flange 74 is rotated into contact with the shoulder 78 of the spray arm 40 thereby urging the shoulder 78 and hence the spray arm 40 in the counterclockwise direction. Continued rotation of the input shaft 48 in the counterclockwise direction drives the spray arm 40 in the same direction. During such counterclockwise rotation of the input shaft 48, the annular flange 74 blocks the outlet 62 thereby fluidly isolating the fluid chamber 64 of the wing 44 (and hence the nozzles 70) from the central fluid chamber 60 and hence the fluid pump 36. Since the flange 74 does not block the outlet 66 while the input shaft 48 is driving the spray arm 40 in the counterclockwise direction, wash fluid from the fluid pump 36 is directed out of the central fluid chamber 60 through the outlet 66 and into the fluid chamber 68 of the wing 46 where it is sprayed out of the nozzles 72 and onto the dish racks 16.

Figure 6:
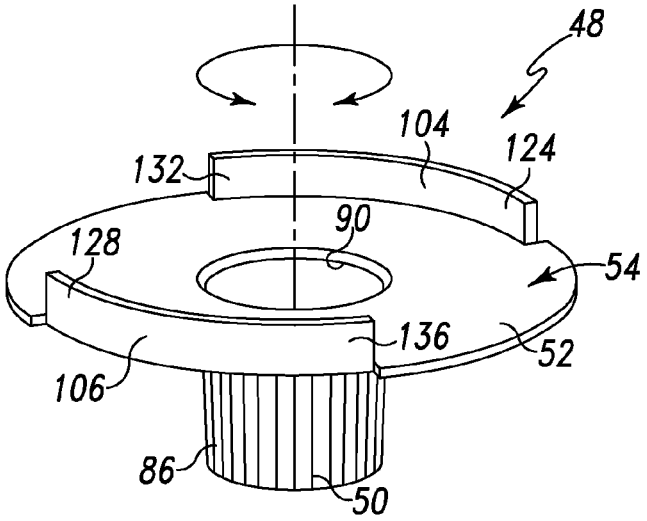
FIG. 6 is a view similar to FIG. 3, but showing the input shaft of a second embodiment of the spray assembly.
Figure 7:
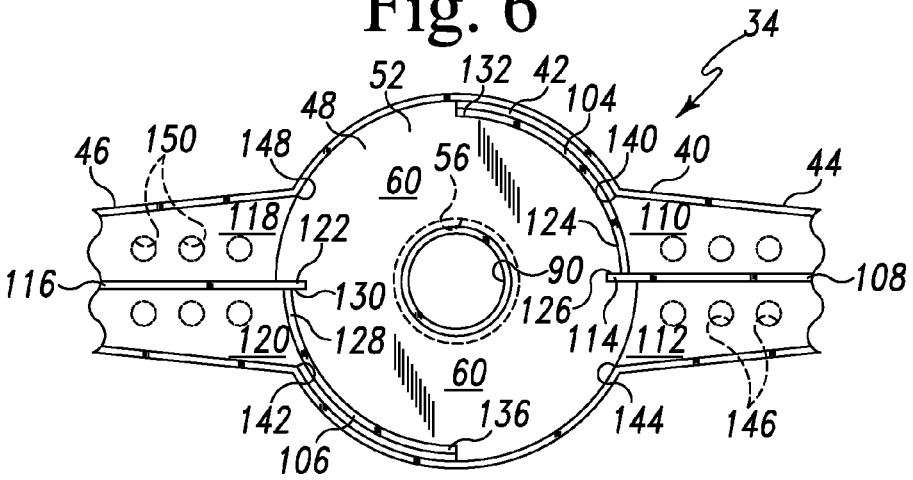
FIG. 7 is a diagrammatic view showing the second embodiment of the spray assembly being driven in the clockwise direction.
Figure 8:
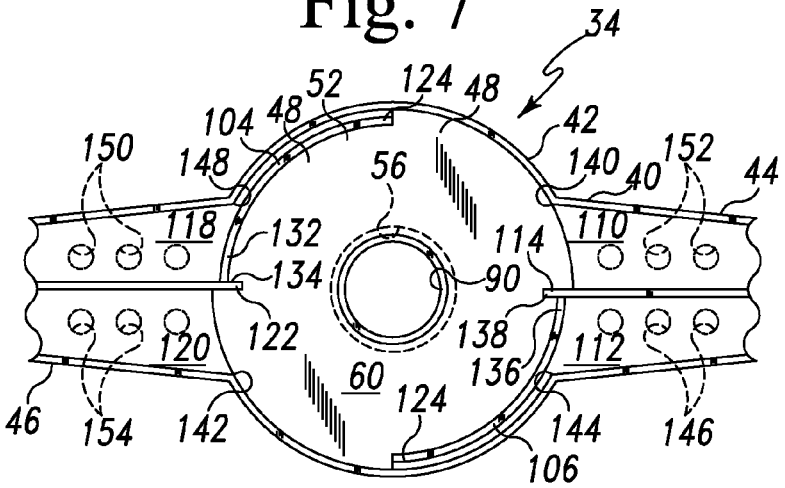
FIG. 8 is a view similar to FIG. 7, but showing the second embodiment of the spray assembly being driven in the counterclockwise direction.

Referring now to FIGS. 6-8, there is shown another embodiment of the spray assembly 34. The spray assembly 34 of FIGS. 6-8 is somewhat similar to the spray assembly described above in regard to FIGS. 2-5 except that each of the wings 44, 46 of the spray arm 40 have two fluid chambers instead of one. The input shaft 48 has also been modified to selectively direct wash fluid between the additional fluid chambers. Common reference numerals have been used in FIGS. 6-8 to designate common components to those described in regard to FIGS. 1-5.

As shown in FIG. 6, the disk 52 of the upper end 54 of the input shaft 48 has two annular-shaped flanges 104, 106 extending upwardly from the periphery of the disk 52. Like the flange 74 described above, the flanges 104, 106 engage the spray arm 40 to drive the spray arm 40 in either a clockwise or counterclockwise direction. As shown in FIGS. 7 and 8, a rib 108 is positioned in the fluid chamber of the wing 44 and extends along its length so as to form a pair of separate fluid chambers 110, 112 in the wing 44. An end of the rib 108 extends into the central fluid chamber 60 of the spray arm's central hub 42 to define a shoulder 114. A rib 116 is positioned in the fluid chamber of the wing 46 and extends along its length so as to form a pair of separate fluid chambers 118, 120 in the wing 46. An end of the rib 116 extends into the central fluid chamber 60 of the spray arm's central hub 42 to define a shoulder 122.

As can be seen best in FIG. 7, when the input shaft 48 is rotated in the clockwise direction, an end 124 of the flange 104 is rotated into contact with a side 126 of the shoulder 114, and an end 128 of the flange 106 is rotated into contact with a side 130 of the shoulder 122 thereby urging the shoulders 114, 122 and hence the spray arm 40 in the clockwise direction. Continued rotation of the input shaft 48 in the clockwise direction drives the spray arm 40 in the same direction. Conversely, as can be seen best in FIG. 8, when the input shaft 48 is rotated in the counterclockwise direction, an end 132 of the flange 104 is rotated into contact with the opposite side 134 of the shoulder 122, and an end 136 of the flange 106 is rotated into contact with the opposite side 138 of the shoulder 114 thereby urging the shoulders 114, 122 and hence the spray arm 40 in the counterclockwise direction. Continued rotation of the input shaft 48 in the counterclockwise direction drives the spray arm 40 in the same direction.

Like the input shaft described above in regard to FIGS. 2-5, the input shaft 48 of FIGS. 6-8 also functions as a valve to selectively divert wash fluid between each of the fluid chambers of the wings 44, 46 of the spray arm 40. In particular, as shown in FIG. 7, when the input shaft 48 is driving the spray arm 40 in the clockwise direction, the flange 104 blocks or otherwise occludes the outlet 140 of the central fluid chamber 60 thereby isolating the fluid chamber 110 of the wing 44 (and hence the nozzles 152) from the central fluid chamber 60 and hence the fluid pump 36. Likewise, the flange 106 blocks or otherwise occludes the outlet 142 of the central fluid chamber 60 thereby isolating the fluid chamber 120 of the wing 46 (and hence the nozzles 154) from the central fluid chamber 60 and hence the fluid pump 36. However, the flange 106 does not block the outlet 144 of the central fluid chamber 60 while the input shaft 48 is driving the spray arm 40 in the clockwise direction thereby directing wash fluid pumped from the pump 36 out of the central fluid chamber 60 through the outlet 144 and into the fluid chamber 112 of the wing 44 where it is sprayed out the nozzles 146. Moreover, the flange 104 does not block the outlet 148 of the central fluid chamber 60 while the input shaft 48 is driving the spray arm 40 in the clockwise direction thereby directing wash fluid pumped from the pump 36 out of the central fluid chamber 60 through the outlet 148 and into the fluid chamber 118 of the wing 46 where it is sprayed out the nozzles 150.

Conversely, as shown in FIG. 8, when the input shaft 48 is driving the spray arm 40 in the counterclockwise direction, the flange 106 blocks or otherwise occludes the outlet 144 of the central fluid chamber 60 thereby isolating the fluid chamber 112 of the wing 44 (and hence the nozzles 146) from the central fluid chamber 60 and hence the fluid pump 36. Likewise, the flange 104 blocks or otherwise occludes the outlet 148 of the central fluid chamber 60 thereby isolating the fluid chamber 118 of the wing 46 (and hence the nozzles 150) from the central fluid chamber 60 and hence the fluid pump 36. However, the flange 104 does not block the outlet 140 of the central fluid chamber 60 while the input shaft 48 is driving the spray arm 40 in the counterclockwise direction thereby directing wash fluid pumped from the pump 36 out of the central fluid chamber 60 through the outlet 140 and into the fluid chamber 110 of the wing 44 where it is sprayed out the nozzles 152. Moreover, the flange 106 does not block the outlet 142 of the central fluid chamber 60 while the input shaft 48 is driving the spray arm 40 in the counterclockwise direction thereby directing wash fluid pumped from the pump 36 out of the central fluid chamber 60 through the outlet 142 and into the fluid chamber 120 of the wing 46 where it is sprayed out the nozzles 154.

While the disclosure has been illustrated and described in detail in the drawings and foregoing description, such an illustration and description is to be considered as exemplary and not restrictive in character, it being understood that only illustrative embodiments have been shown and described and that all changes and modifications that come within the spirit of the disclosure are desired to be protected.

There are a plurality of advantages of the present disclosure arising from the various features of the apparatus, system, and method described herein. It will be noted that alternative embodiments of the apparatus, system, and method of the present disclosure may not include all of the features described yet still benefit from at least some of the advantages of such features. Those of ordinary skill in the art may readily devise their own implementations of the apparatus, system, and method that incorporate one or more of the features of the present invention and fall within the spirit and scope of the present disclosure as defined by the appended claims.

The invention claimed is:

1. A dishwasher, comprising:

a tub defining a washing chamber, one or more dish racks positioned in the washing chamber, a rotating spray arm positioned in the washing chamber to spray wash fluid on the one or more dish racks, the rotating spray arm comprising: (i) a hub defining a central fluid chamber having a first outlet and a second outlet, (ii) a first wing extending outwardly from the hub, the first wing having a first fluid chamber that is fluidly coupled to the central fluid chamber via the first outlet, and (iii) a second wing extending outwardly from the hub, the second wing having a second fluid chamber that is fluidly coupled to the central fluid chamber via the second outlet, and an input shaft having a first end positioned in the hub of the spray arm and a second end extending outwardly from the hub of the spray arm, wherein (i) the input shaft is rotatable relative to the spray arm, (ii) the first end of the input shaft comprises a flange, (iii) rotation of the input shaft in a clockwise direction causes the flange to (a) drive the spray arm in the clockwise direction by conveyance of rotational force from the input shaft to the spray arm, and (b) prevent wash fluid from advancing through the second outlet of the central fluid chamber of the spray arm, and (iv) rotation of the input shaft in a counterclockwise direction causes the flange to (a) drive the spray arm in the counterclockwise direction by conveyance of rotational force from the input shaft to the spray arm, and (b) prevent wash fluid from advancing through the first outlet of the central fluid chamber of the spray arm.

2. The dishwasher of claim 1, wherein:

the input shaft comprises a cannulated stem having a disk secured thereto, the disk is positioned in the hub of the spray arm, and the flange comprises an annular-shaped flange secured to a portion of an outer periphery of the disk.

3. The dishwasher of claim 1, wherein:

the hub of the spray arm comprises a sidewall having a first shoulder and a second shoulder extending inwardly from the sidewall into the central fluid chamber, rotation of the input shaft in a clockwise direction causes the flange to contact the second shoulder so as to drive the spray arm in the clockwise direction, and rotation of the input shaft in a counterclockwise direction causes the flange to contact the first shoulder so as to drive the spray arm in the counterclockwise direction.

4. The dishwasher of claim 3, wherein:

the flange fluidly isolates the first fluid chamber of the first wing from the central fluid chamber when the flange is positioned in contact with the first shoulder, and the flange fluidly isolates the second fluid chamber of the second wing from the central fluid chamber when the flange is positioned in contact with the second shoulder.

5. The dishwasher of claim 1, wherein:

the input shaft comprises a cannulated stem having a disk secured thereto, the disk is positioned in the hub of the spray arm, a bore extends through the stem and opens into the central fluid chamber of the spray arm, and a second end of the cannulated stem is fluidly coupled to a fluid pump such that fluid pumped by the fluid pump is advanced through the stem and into the central fluid chamber.

6. The dishwasher of claim 1, wherein the input shaft is coupled to an output of a drive motor.

7. The dishwasher of claim 1, wherein the second wing extends outwardly from the hub in a direction opposite the first wing.

8. The dishwasher of claim 1, wherein:

the first wing of the spray arm comprises a first rib that divides the first fluid chamber of the first wing into a pair of separate fluid chambers, the second wing of the spray arm comprises a second rib that divides the second fluid chamber of the second wing into a pair of separate fluid chambers, rotation of the input shaft in a clockwise direction causes the flange to contact the first rib so as to drive the spray arm in the clockwise direction, and rotation of the input shaft in a counterclockwise direction causes the flange to contact the second rib so as to drive the spray arm in the counterclockwise direction.

9. The dishwasher of claim 8, wherein:

the flange fluidly isolates one of the pair of separate fluid chambers of the first wing from the central fluid chamber when the flange is positioned in contact with the first rib, the other of the pair of separate fluid chambers of the first wing being fluidly coupled to the central fluid chamber when the flange is positioned in contact with the first rib, and the flange fluidly isolates one of the pair of separate fluid chambers of the second wing from the central fluid chamber when the flange is positioned in contact with the second rib, the other of the pair of separate fluid chambers of the second wing being fluidly coupled to the central fluid chamber when the flange is positioned in contact with the second rib.

10. A dishwasher, comprising:

a tub defining a washing chamber, one or more dish racks positioned in the washing chamber, a rotating spray arm positioned in the washing chamber to spray wash fluid on the one or more dish racks, the rotating spray arm comprising; (i) a hub defining a central fluid chamber, (ii) a first wing extending outwardly from the hub, the first wing having a first fluid chamber, and (iii) a second wing extending outwardly from the hub, the second wing having a second fluid chamber, and an input shaft rotatable relative to the spray arm, the input shaft comprises a flange positioned in the central fluid chamber of the spray arm, wherein (i) rotation of the input shaft in a clockwise direction causes the flange to (a) drive the spray arm in the clockwise direction by conveyance of rotational force from the input shaft to the spray arm, and (b) fluidly isolate the second fluid chamber of the second wing from the central fluid chamber of the spray arm, and (ii) rotation of the input shaft in a counterclockwise direction causes the flange to (a) drive the spray arm in the counterclockwise direction by conveyance of rotational force from the input shaft to the spray arm, and (b) fluidly isolate the first fluid chamber of the first wing from the central fluid chamber of the spray arm.

11. The dishwasher of claim 10, wherein:

the input shaft comprises a cannulated stem having a disk secured thereto, the disk is positioned in the hub of the spray arm, and the flange comprises an annular-shaped flange secured to a portion of an outer periphery of the disk.

12. The dishwasher of claim 10, wherein:

the hub of the spray arm comprises a sidewall having a first shoulder and a second shoulder extending inwardly from the sidewall into the central fluid chamber, rotation of the input shaft in a clockwise direction causes the flange to contact the second shoulder so as to drive the spray arm in the clockwise direction, and rotation of the input shaft in a counterclockwise direction causes the flange to contact the first shoulder so as to drive the spray arm in the counterclockwise direction.

13. The dishwasher of claim 12, wherein:

the flange fluidly isolates the first fluid chamber of the first wing from the central fluid chamber when the flange is positioned in contact with the first shoulder, and the flange fluidly isolates the second fluid chamber of the second wing from the central fluid chamber when the flange is positioned in contact with the second shoulder.

14. The dishwasher of claim 10, wherein:

the input shaft comprises a cannulated stem having a disk secured thereto, the disk is positioned in the hub of the spray arm, a bore extends through the stem and opens into the central fluid chamber of the spray arm, and a second end of the cannulated stem is fluidly coupled to a fluid pump such that fluid pumped by the fluid pump is advanced through the stem and into the central fluid chamber.

15. The dishwasher of claim 10, wherein the input shaft is coupled to an output of a drive motor.

16. The dishwasher of claim 10, wherein the second wing extends outwardly from the hub in a direction opposite the first wing.

17. The dishwasher of claim 10, wherein:

the first wing of the spray arm comprises a first rib that divides the first fluid chamber of the first wing into a pair of separate fluid chambers, the second wing of the spray arm comprises a second rib that divides the second fluid chamber of the second wing into a pair of separate fluid chambers, rotation of the input shaft in a clockwise direction causes the flange to contact the first rib so as to drive the spray arm in the clockwise direction, and rotation of the input shaft in a counterclockwise direction causes the flange to contact the second rib so as to drive the spray arm in the counterclockwise direction.

18. The dishwasher of claim 17, wherein:

the flange fluidly isolates one of the pair of separate fluid chambers of the first wing from the central fluid chamber when the flange is positioned in contact with the first rib, the other of the pair of separate fluid chambers of the first wing being fluidly coupled to the central fluid chamber when the flange is positioned in contact with the first rib, and the flange fluidly isolates one of the pair of separate fluid chambers of the second wing from the central fluid chamber when the flange is positioned in contact with the second rib, the other of the pair of separate fluid chambers of the second wing being fluidly coupled to the central fluid chamber when the flange is positioned in contact with the second rib.

19. A dishwasher, comprising:

a tub defining a washing chamber, one or more dish racks positioned in the washing chamber, a rotating spray arm positioned in the washing chamber to spray wash fluid on the one or more dish racks, the rotating spray arm comprising a hub with a pair of wings extending outwardly therefrom, an input shaft rotatable relative to the spray arm, the input shaft comprising a first end positioned in the hub of the spray arm and a second end extending outwardly from the hub of the spray arm, and a fluid pump fluidly coupled to the second end of the input shaft, wherein (i) rotation of the input shaft in a clockwise direction causes the input shaft to (a) drive the spray arm in the clockwise direction by conveyance of rotational force from the input shaft to the spray arm, and (b) isolate the fluid pump from a number of spray nozzles of the second wing of the spray arm, and (ii) rotation of the input shaft in a counterclockwise direction causes the input shaft to (a) drive the spray arm in the counterclockwise direction by conveyance of rotational force from the input shaft to the spray arm, and (b) isolate the fluid pump from a number of spray nozzles of the first wing of the spray arm.

20. The dishwasher of claim 19, wherein:

the input shaft comprises a cannulated stem having a disk secured thereto, and the disk is positioned in the hub of the spray arm, the disk has an annular-shaped flange secured to a portion of an outer periphery thereof.

21. The dishwasher of claim 19, wherein:

the hub of the spray arm comprises a sidewall having a first shoulder and a second shoulder extending inwardly from the sidewall into a central fluid chamber, rotation of the input shaft in a clockwise direction causes a flange to contact the second shoulder so as to drive the spray arm in the clockwise direction, and rotation of the input shaft in a counterclockwise direction causes the flange to contact the first shoulder so as to drive the spray arm in the counterclockwise direction.

22. The dishwasher of claim 21, wherein:

the flange fluidly isolates the fluid pump from the number of spray nozzles of the second wing of the spray arm when the flange is positioned in contact with the first shoulder, and the flange fluidly isolates the fluid pump from the number of spray nozzles of the first wing of the spray arm when the flange is positioned in contact with the second shoulder.

23. The dishwasher of claim 19, wherein the input shaft is coupled to an output of a drive motor.

24. The dishwasher of claim 19, wherein the second wing extends outwardly from the hub in a direction opposite the first wing.

25. The dishwasher of claim 19, wherein:

the number of spray nozzles of the first wing comprises a first plurality of spray nozzles and a second plurality of spray nozzles, the first wing of the spray arm comprises a first rib that fluidly isolates the first plurality of spray nozzles of the first wing from the second plurality of spray nozzles of the first wing, the number of spray nozzles of the second wing comprises a first plurality of spray nozzles and a second plurality of spray nozzles, the second wing of the spray arm comprises a second rib that fluidly isolates the first plurality of spray nozzles of the second wing from the second plurality of spray nozzles of the second wing, rotation of the input shaft in a clockwise direction causes a flange to contact the first rib so as to drive the spray arm in the clockwise direction, and rotation of the input shaft in a counterclockwise direction causes the flange to contact the second rib so as to drive the spray arm in the counterclockwise direction.

26. The dishwasher of claim 25, wherein:

the flange fluidly isolates the first plurality of spray nozzles of the first wing from the fluid pump when the flange is positioned in contact with the first rib, the second plurality of spray nozzles of the first wing being fluidly coupled to the fluid pump when the flange is positioned in contact with the first rib, and the flange fluidly isolates the first plurality of spray nozzles of the second wing from the fluid pump when the flange is positioned in contact with the second rib, the second plurality of spray nozzles of the second wing being fluidly coupled to the fluid pump when the flange is positioned in contact with the second rib.

* * * * *